US008991373B2

(12) United States Patent
Cummings

(10) Patent No.: US 8,991,373 B2
(45) Date of Patent: Mar. 31, 2015

(54) TOY CROSSBOW PROJECTILE LAUNCHER WITH EXTENDABLE BODY AND SAFETY RELEASE

(71) Applicant: KMA Concepts Limited, Tsim Sha Tsui, Kowloon (HK)

(72) Inventor: Peter Cummings, Kowloon (HK)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 0 days.

(21) Appl. No.: 13/964,027

(22) Filed: Aug. 9, 2013

(65) Prior Publication Data

US 2014/0338647 A1 Nov. 20, 2014

Related U.S. Application Data

(63) Continuation-in-part of application No. 29/455,281, filed on May 19, 2013.

(51) Int. Cl.
*F41B 3/02* (2006.01)
*F41B 7/08* (2006.01)

(52) U.S. Cl.
CPC .... *F41B 7/08* (2013.01); *F41B 3/02* (2013.01)
USPC ..... 124/20.3

(58) Field of Classification Search
USPC ..... 124/20.1, 20.3, 25, 35.2
See application file for complete search history.

(56) References Cited

U.S. PATENT DOCUMENTS

| | | | | |
|---|---|---|---|---|
| 3,749,076 | A * | 7/1973 | Suski et al. | 124/31 |
| 4,895,061 | A | 1/1990 | Baricos et al. | |
| 5,749,348 | A * | 5/1998 | Oviedo-Reyes | 124/25 |
| 5,894,672 | A * | 4/1999 | Ellenburg et al. | 33/265 |
| 5,931,145 | A * | 8/1999 | Oviedo-Reyes | 124/20.3 |
| 6,500,042 | B1 * | 12/2002 | LaPointe | 446/64 |
| 6,925,744 | B2 | 8/2005 | Kincel | |
| 7,748,370 | B1 | 7/2010 | Choma | |
| 2003/0093908 | A1 | 5/2003 | Lee | |
| 2012/0160224 | A1 | 6/2012 | Walterscheid | |

FOREIGN PATENT DOCUMENTS

CN 203069048 7/2013

* cited by examiner

*Primary Examiner* — John Ricci
(74) *Attorney, Agent, or Firm* — LaMorte & Associates P.C.

(57) ABSTRACT

A toy projectile launcher assembly has the form of a crossbow. The crossbow only launches the safety projectiles that are provided. The launcher body has a handle at a first end and diverging support arms at an opposite second end. An adjustment mechanism is contained within the launcher body for selectively adjusting the length of the launcher body. The crossbow has diverging support arms. Bow arms are attached to the support arms. The bow arms pivot from retracted positions to extended positions when a projectile is loaded into the toy crossbow. The toy crossbow has elastic loops that can only engage specialized safety projectiles with side. Furthermore, the trigger mechanism can only engage the safety projectiles provided with the toy. Projectiles without a specific tab and keyhole cannot be loaded into the toy crossbow.

19 Claims, 4 Drawing Sheets

TOY CROSSBOW PROJECTILE LAUNCHER WITH EXTENDABLE BODY AND SAFETY RELEASE

RELATED APPLICATIONS

This application is a continuation-in-part of co-pending U.S. patent application Ser. No. 29/455,281 filed May 19, 2013.

BACKGROUND OF THE INVENTION

1. Field of the Invention

In general, the present invention relates to toy crossbow systems that project toy arrows into flight. More particularly, the present invention relates to the structure of toy projectile launchers and the mechanisms for loading and releasing projectiles.

2. Prior Art Description

Crossbows that are designed for child's play have existed since the Middle Ages. In the modern era, toy crossbows typically have a plastic molded body and an elastic string. The string is drawn along a rail on the toy's body and is locked to a trigger. Arrows, sometimes referred to as "bolts", are launched by placing the arrow on the rail in front of the drawn string. The trigger is released, therein causing the string to move forward and propel the arrow into flight.

Due to the nature of its design, any crossbow, including toy crossbows, are capable of launching most any object that is placed on the rail in front of the string. Although a toy crossbow may be sold with safety projectiles, a child can easily launch a stick or a metal-cast toy model with equal ease. It will therefore be understood that even toy crossbows can become dangerous if loaded with unsafe projectiles and used in an unwise fashion.

Another problem with toy crossbows is their tendency to misfire after being used for a period of time. Toy crossbows mostly have an all-plastic construction. In most crossbow designs, the string of the crossbow must be drawn and set into the trigger catch before the projectile is set in place. This produces a significant amount of wear against the plastic trigger catch. As the plastic trigger catch begins to wear, it diminishes in size. This tends to cause the string to slip from the trigger catch and fire before the projectile is set or before the projectile can be directed toward a safe target. Consequently, the toy crossbow can become an unsafe product.

A need therefore exists for a toy crossbow design that enables the toy crossbow to shoot only the safety projectiles that are packaged with the toy crossbow. Furthermore, a need exists for a crossbow design that improves the trigger mechanism in a manner that inhibits misfiring. These needs are met by the present invention as described and claimed below.

SUMMARY OF THE INVENTION

The present invention is a toy projectile launcher assembly in the form of a crossbow. The crossbow launches safety projectiles. Only authorized safety projectiles that are packaged with the toy can be launched. The crossbow is incapable of firing ordinary objects, even arrows, that are unauthorized.

The toy crossbow has a launcher body of a predetermined length. The launcher body has a handle at a first end and diverging support arms at an opposite second end. An adjustment mechanism is contained within the launcher body for selectively adjusting the predetermined length of the launcher body. This selectively controls the draw length needed to load projectiles.

The crossbow has diverging support arms. Bow arms are attached to the support arms. The bow arms pivot from retracted positions to extended positions when a projectile is loaded into the toy crossbow. Furthermore, the toy crossbow has elastic loops in place of a drawstring. The elastic loops can only engage specialized safety projectiles that have side hooks for engaging the elastic loops.

The trigger mechanism provided with the toy crossbow also can only engage the safety projectiles provided with the toy. The safety projectiles have rear tabs with keyholes. The trigger mechanism provides a catch that fits into the keyhole and engages the projectile to hold it in a loaded position. Projectiles without the specific tab and keyhole cannot be loaded into the toy crossbow.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy crossbow can be embodied in many ways, only one exemplary embodiment of the present invention toy crossbow is illustrated. The exemplary embodiment has been selected in order to set forth the best mode contemplated for the invention. The illustrated embodiment, however, is merely exemplary and should not be considered a limitation when interpreting the scope of the appended claims.

Figure 1:
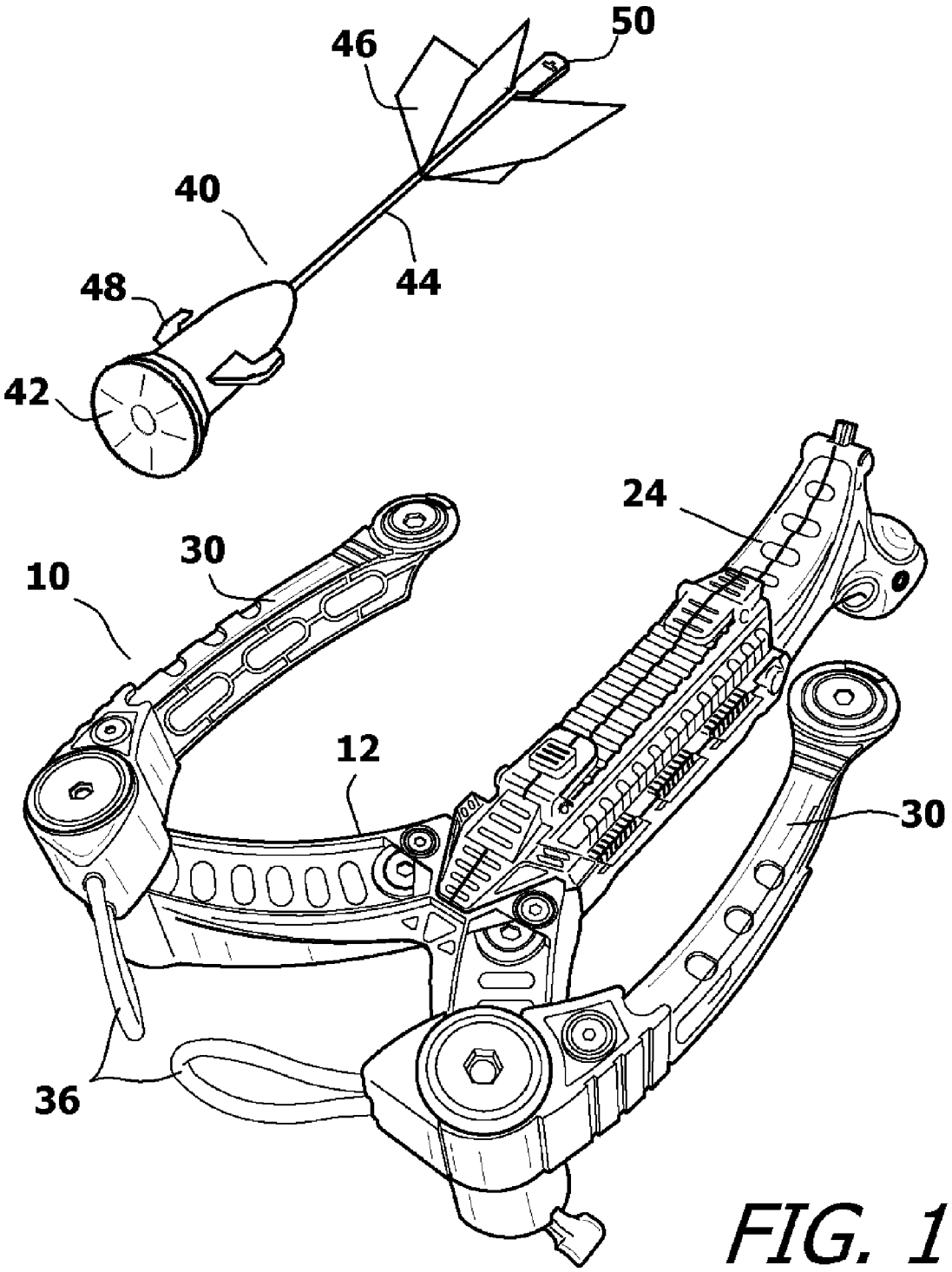
FIG. 1 is a perspective view of an exemplary embodiment of a toy crossbow assembly and safety projectile in combination.
Figure 2:
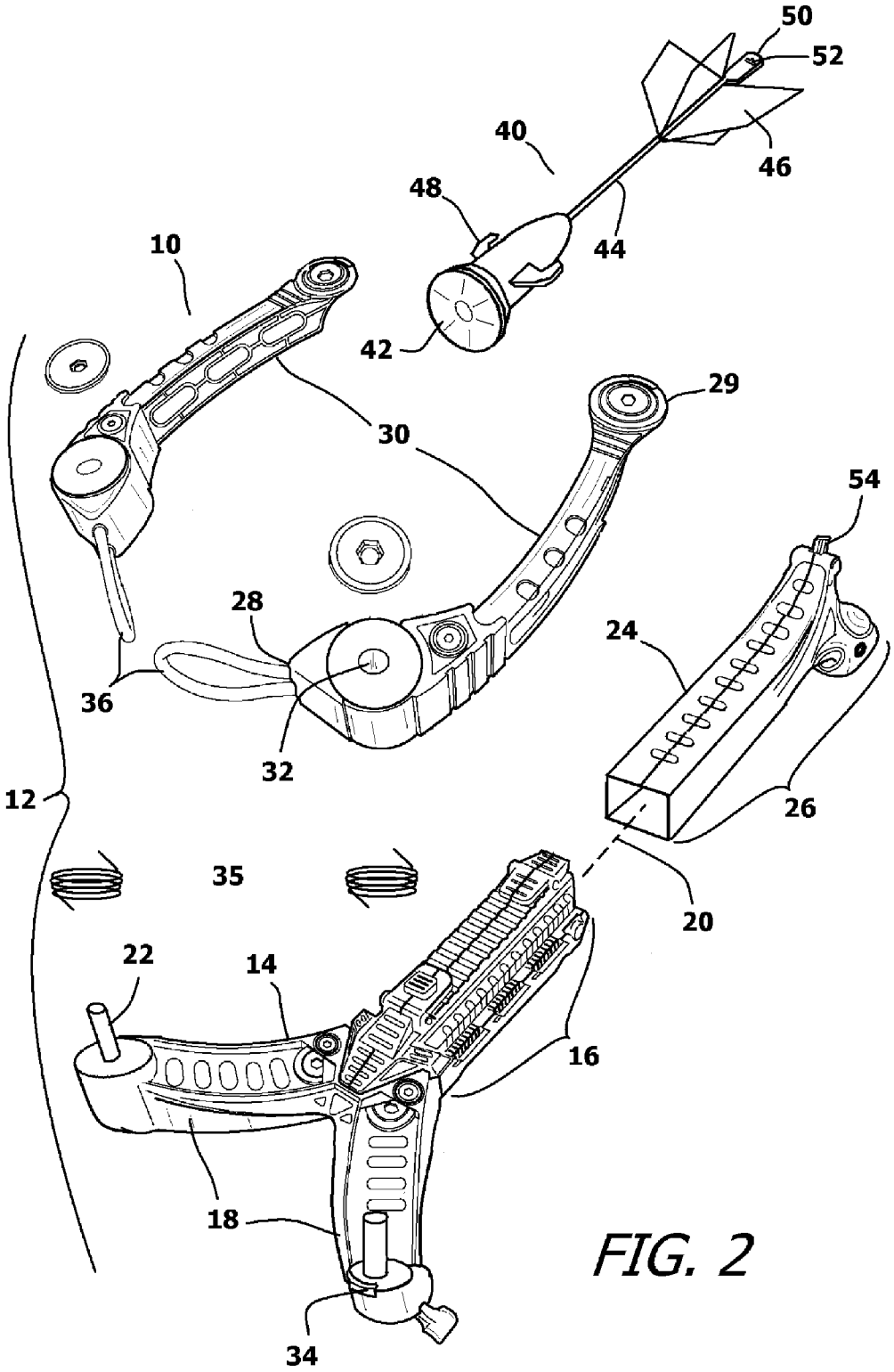
FIG. 2 is an exploded view of the embodiment of FIG. 1.

Referring to FIG. 1 in conjunction with FIG. 2, a first exemplary embodiment of a toy crossbow assembly 10 is shown. The toy crossbow assembly 10 has a complex body 12 that enables the body 12 to be selectively configured into different shapes as the toy crossbow assembly 10 is loaded, cocked and fired. The body 12 includes a Y-shaped section 14. The Y-shaped section 14 has a hollow base 16 that leads into two diverging support arms 18. The hollow base 16 extends along a linear first axis 20. The two support arms 18 curve upwardly above the first axis 20 as they diverge.

A pivot post 22 extends upwardly from each of the support arms 18. The pivot posts 22 are parallel to each other and generally perpendicular to the line of the first axis 20.

The crossbow body 12 also contains a handle section 24. The handle section 24 has a straight segment 26 that is sized to pass into the hollow base 16 of the Y-shaped section 14 in a telescoping manner. As will later be explained in more detail, the straight segment 26 can move reciprocally within the hollow base 16 of the Y-shaped section 14. Furthermore, the straight segment 26 can be selectively locked into place within the hollow base 16 at different points. As such, the body 12 of the toy crossbow assembly 10 has an overall body length that can be selectively altered by advancing and retreating the straight segment 26 of the handle section 24 into, and out of, the hollow base 16 of the Y-shaped section 14.

Two crossbow arms 30 are provided. Each of the crossbow arms 30, has a first end 28, a second end 29, and a pivot hole 32 disposed near the first end 28. The pivot hole 32 is sized to pass onto the pivot post 22 that extends vertically from the Y-shaped section 14 of the crossbow body 12. Once the pivot holes 32 of a crossbow arms 30 are connected to the pivot posts 22, the crossbow arms 30 are free to rotate about the pivot posts 22 through a limited range. The range of rotational movement is controlled by mechanical stops 34 that are formed into the Y-shaped section 14 of the body 12 and the crossbow arms 30. The mechanical stops 34 enable a rotational range of motion of between seventy degrees and 110 degrees. This enables the crossbow arms 30 to pivot about the pivot posts 22 from a fully retracted position to a fully extended position. In the fully retracted position, such as is shown in FIG. 1, the crossbow arms 30 are generally aligned in parallel with the first axis 20 of the handle section 24 of the body 12. Conversely, when the crossbow arms 30 are in the fully extended position, such as is shown in FIG. 3, the crossbow arms 30 rotate to an orientation that is near perpendicular to the first axis 20 of the handle section 24.

A torsion spring 35 is provided around each of the pivot posts 22. The torsion springs 35 provide a spring bias to the crossbow arms 30 that bias the crossbow arms 30 into the fully retracted position shown in FIG. 1. It will therefore be understood that when the crossbow arms 30 are moved to the fully extended position, such as is shown in FIG. 3, the torsion springs 35 are moved against their bias and store spring energy.

Figure 3:
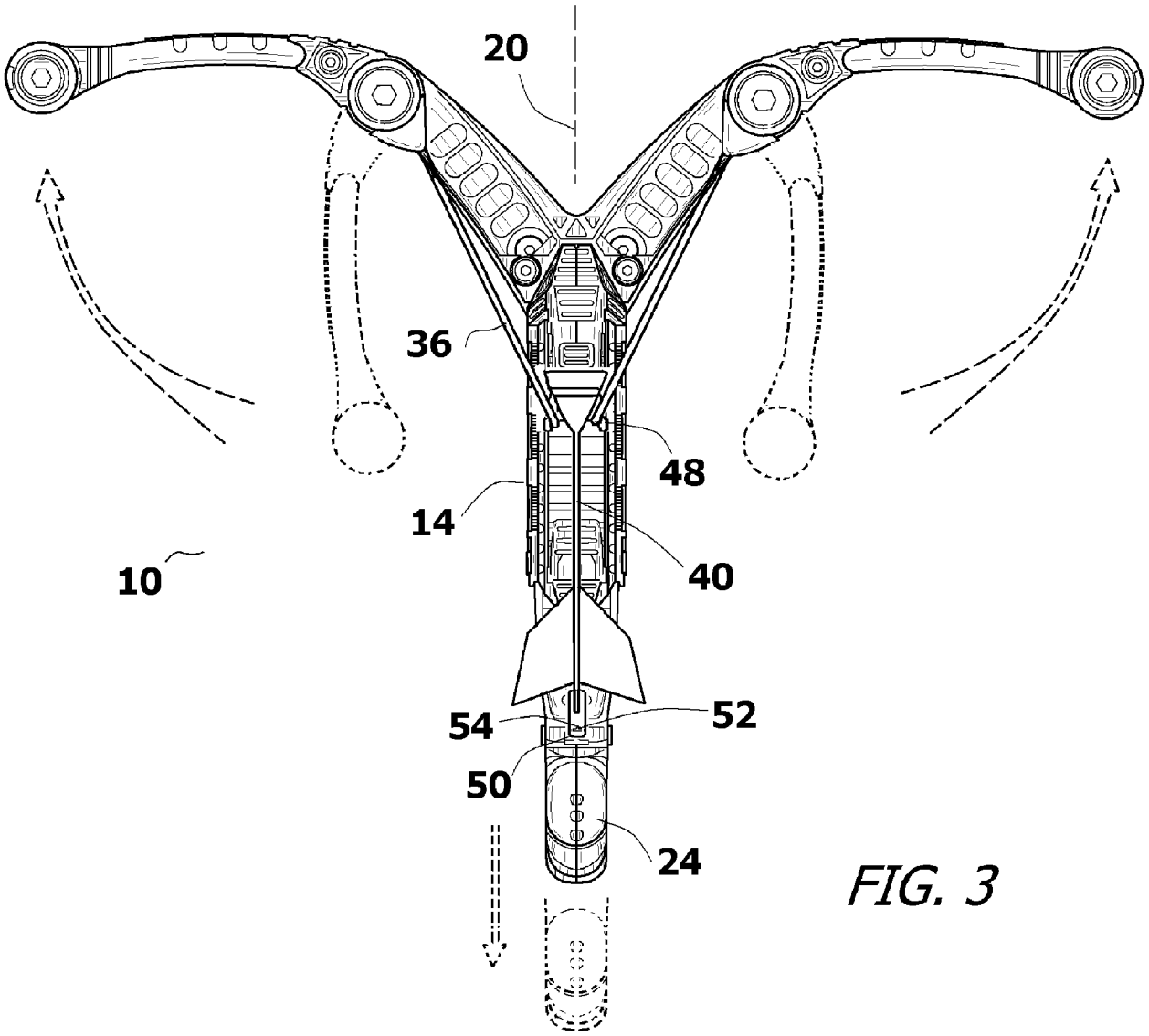
FIG. 3 is a top view of the combination of FIG. 1 having the projectile loaded into the toy crossbow assembly.

Referring to FIG. 3 in conjunction with both FIG. 1 and FIG. 2, it can be seen that elastic loops 36 extend from first ends 28 of the crossbow arms 30. The elastic loops 36 are fabricated from an elastic material, such as rubber tubing, or an elastomeric material such as a TPR polymer. When the crossbow arms 30 are in the fully retracted position, the two elastic loops 36 extend near each other at the front of the toy crossbow assembly 10.

The toy crossbow assembly 10 is part of an overall toy system that includes specially formed safety projectiles 40. Each safety projectile 40 is a simulated arrow that has a head 42, a shaft 44 and a tail 46. The head 42 of each safety projectile 40 is preferably made of a foam rubber or similar low-density polymer formulation for safety. The head 42 of the safety projectile 40 can be blunt or can be formed as a suction cup.

Hooks 48 are formed on the head 42 of the safety projectile 40 near the rear of the head 42. The hooks 48 extend from opposite sides of the head 42. The shaft 44 extends from the head 42 to the rear of the overall projectile 40. At the rear of the safety projectile 40, the shaft terminates with a flattened tab 50. On the flattened tab 50 is formed one or more key holes 52. The key holes 52 preferably have a complex shape in the form of a complex polygon or an asymmetrical polygon. The complex shape of the key holes 52 helps ensure that only the safety projectile 40 is loadable into the toy crossbow assembly 10, as is explained below.

From FIG. 3, it can be seen that in order to load the safety projectile 40 into the toy crossbow assembly 10, the hooks 48 on the safety projectile 40 are engaged with the elastic loops 36. The safety projectile 40 is then pulled in the direction of the first axis 20 until the tab 52 of the projectile 40 reaches a protruding catch 54. The protruding catch 54 is straight, yet has a cross-sectional profile that matches the complex shape of the key hole 52 on the tab 50 of the safety projectile 40. This enables the protruding catch 54 to pass into the key hole 52 and mechanically engage the tab 50 of the safety projectile 40. If a projectile does not have a key hole or a key hole of the proper shape, then the protruding catch 54 would have no be able to engage the projectile. It will therefore be understood that the protruding catch 54 is specific to the safety projectile 40 provided and will not engage sticks, tinker toys, arrows from other toys, or any other unsafe projectile.

As the hooks 48 from the safety projectile 40 engage the elastic loops 36, the safety projectile 40 applies tension to the elastic loops 36 and begins to stretch the elastic loops 36. As tension is applied to the elastic loops 36, the elastic loops 36 cause the crossbow arms 30 to pivot about the pivot posts 22 and rotate from the fully retracted position toward the fully extended position. The safety projectile 40 eventually is connected to the protruding catch 54. Once the safety projectile 40 is engaged with the protruding catch 54, the toy crossbow assembly 10 is loaded, cocked, and ready for firing.

The velocity at which the safety projectile 40 is launched is directly proportional to the tension experienced by the elastic loops 36. The greater the tension, the more energy is stored by the elastic loops 36 and the greater the release velocity. To selectively control the tension in the elastic loops 36, the handle section 24 of the body 12 can be extended. As has been previously mentioned, the handle section 24 of the crossbow body 12 is reciprocally extendable from the Y-shaped section 14. By extending the handle section 24, the protruding catch 54 can be moved farther away from the elastic loops 36. Consequently, the elastic loops 36 are forced to stretch longer as the handle section 24 is extended on the toy crossbow assembly 10.

By providing a handle section 24 that can be selectively extended, the launching power of the toy crossbow assembly 10 can be controlled by the user. The toy crossbow assembly 10 can therefore be adjusted for both safe indoor play and outdoor play. Likewise, the launching power can be adjusted for use with safety projectiles 40 of different weights.

Figure 4:
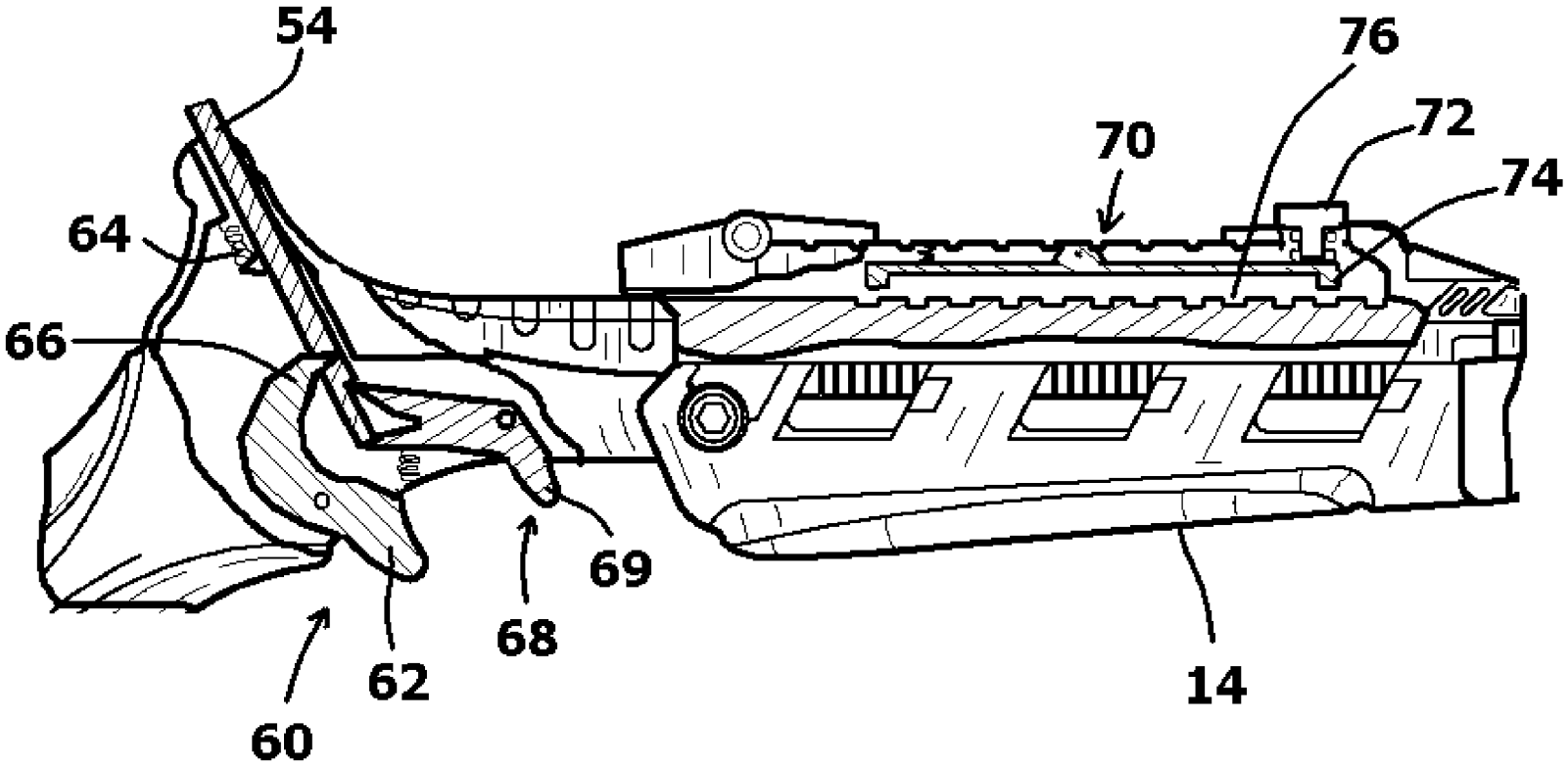
FIG. 4 is a cross-sectional view of the laucher body of the toy crossbow assembly showing the internal length adjustment mechanism and trigger mechanism.

Referring to FIG. 4 in conjunction with FIG. 2, an exemplary trigger mechanism 60 and exemplary length adjustment mechanism 70 for the toy crossbow assembly 10 are shown. The length adjustment mechanism 70 is a simple pivot latch. A button 72 is provided on the exterior of the Y-shaped section 14. The button 72 depresses a spring loaded latch 74 when depressed. The latch 74 engages ridges 76 on the straight segment 26 of the handle section 24. The latch 74 is disengaged when the button 72 is pressed. This enables the straight segment 26 to freely move back and forth within the Y-shaped section 14. Once adjusted to the proper overall length, the button 72 is released.

The trigger mechanism 60 includes a trigger pull 62. The protruding catch 54 is set in a slot and is biased into its protruding condition by a spring 64. When the trigger pull 62 is manually depressed, the trigger pull 62 moves a cam finger 66. The cam finger 66 engages the protruding catch 54 and moves the protruding catch 54 against the bias of the spring 64. This causes the top of the protruding catch 54 to retract into the handle section 24 and disengage any safety projectile 40 it may have been retaining.

It is preferred that the trigger mechanism 60 also contains a safety lock 68 that prevents the trigger mechanism 60 from being inadvertently activated. The preferred safety lock 68 has a secondary finger pull 69. In order to pull the main trigger pull 62, the secondary finger pull 69 must first be manually pulled. If not pulled, the safety lock 68 prevents the primary trigger pull 62 from moving when pulled.

Referring to all figures, it will be understood that in order to utilize the crossbow assembly 10, a person takes the crossbow assembly 10 and maneuvers the safety projectile 40 until the hooks 48 on the safety projectile 40 engage the elastic loops 36. Only a projectile with properly spaced hooks will work to engage the elastic loops 36. This interconnects the safety projectile 40 with the elastomeric loops 36 of the toy crossbow assembly 10. The safety projectile 40 is then manually grasped and pulled rearwardly along the first axis 20. This causes the elastic loops 36 to stretch and store energy. It also causes the crossbow arms 30 to rotate against the spring bias of the torsion springs 35 and store further energy. The tab 50 of the safety projectile 40 is then engaged with the protruding catch 54 of the trigger mechanism 60. Again, only a projectile with the properly configured tab will be able to engage the protruding catch 54.

The tension in the elastic loops 36 can be increased by extending the handle section 24 of the crossbow body 12. This increases the overall length L1 of the body 12 and makes the elastic loops 36 stretch farther. Once a desired degree of stretch is applied to the elastic loops 36, the trigger mechanism 60 is primed by pressing the secondary finger pull 69 of the safety lock 68. The toy crossbow assembly 10 is then aimed and the primary trigger pull 62 is engaged. This retracts the protruding catch 54 and releases the safety projectile 40 into flight.

It will be understood that the embodiment of the present invention that is illustrated and described is merely exemplary and that a person skilled in the art can make many variations to that embodiment. For instance, the bow structure can have many different ornamental shapes. Likewise, the arrow projectiles can be configured as airplanes, rocket ships or any other flying projectile. All such embodiments are intended to be included within the scope of the present invention as defined by the claims.

What is claimed is:

1. A toy projectile launcher assembly, comprising:

a launcher body of a predetermined length having a handle at a first end and diverging support arms at a second end;

an adjustment mechanism contained within said launcher body for selectively adjusting said predetermined length;

bow arms attached to said support arms; and elastic loops, wherein one of said elastic loops is anchored to each of said bow arms.

2. The assembly according to claim 1, wherein said bow arms are attached to said support arms with pivot connections that enable said bow arms to rotate relative said support arms.

3. The assembly according to claim 2, further including torsion springs that bias said bow arms into retracted positions about said pivot connections.

4. The assembly according to claim 1, further including a release catch that extends from said handle and a trigger mechanism for selectively retracting said release catch into said handle.

5. The assembly according to claim 1, wherein said launcher body includes a Y-shaped section that includes a hollow base and said diverging support arms.

6. The assembly according to claim 5, wherein said handle has a straight section that passes into said hollow base of said Y-shaped section.

7. The assembly according to claim 6, wherein said adjustment mechanism controls reciprocal movement of said handle within said hollow base.

8. A toy projectile launcher and safety projectile assembly, wherein said projectile launcher launches said safety projectile into flight, said assembly comprising:

a launcher body having a first support arm and a second support arm;

elastic loops supported by said first support arm and said second support arm;

a projectile having a head, hooks, a tail, and a tab proximate said tail, wherein a key hole of a predetermined shape is formed through said tab; and a trigger mechanism supported by said launcher body, wherein said trigger mechanism includes a catch that engages said projectile by extending through said key hole in said tab, and a trigger pull that retracts said catch out of said key hole when said trigger pull is manually activated.

9. The assembly according to claim 8, wherein said catch has a cross-sectional shape that matches said predetermined shape of said key hole.

10. The assembly according to claim 8, further including bow arms attached to said first support arm and said second support arm with pivot connections that enable said bow arms to rotate relative said first support arm and said second support arm.

11. The assembly according to claim 10, further including torsion springs that bias said bow arms into retracted positions about said pivot connections, wherein said hooks on said projectile engage said elastic loops and rotate said bow arms away from said retracted positions when said tab of said projectile is engaged by said catch.

12. The assembly according to claim 8, wherein said launcher body includes a Y-shaped section that includes a hollow base, wherein said hollow base leads to said first support arm and said second support arm.

13. The assembly according to claim 12, wherein said launcher body further includes a handle having a straight section that passes into said hollow base of said Y-shaped section.

14. The assembly according to claim 13, further including an adjustment mechanism that controls reciprocal movement of said handle within said hollow base.

15. A toy launcher assembly, comprising:

a launcher body having a handle at one end and two support arms at an opposite second end;

bow arms connected to said support arms with pivot connections;

torsion springs for biasing said bow arms into retracted positions about said pivot connections; and elastic loops anchored to said bow arms, wherein said elastic loops cause said bow arms to rotate about said pivot connections from said retracted positions into extended positions when tension is applied to said elastic loops that pull said elastic loops toward said handle of said launcher body.

16. The assembly according to claim 15, wherein said launcher body has a predetermined length and said assembly further includes an adjustment mechanism contained within said launcher body for selectively adjusting said predetermined length.

17. The assembly according to claim 15, further including a release catch that extends from said launcher body and a trigger mechanism for selectively retracting said release catch into said handle.

18. The assembly according to claim 15, wherein said launcher body includes a Y-shaped section that includes a hollow base and said support arms.

19. The assembly according to claim 18, wherein said handle has a straight section that passes into said hollow base of said Y-shaped section in a telescoping manner.

* * * * *